US007056395B1

(12) United States Patent
Guha et al.

(10) Patent No.: US 7,056,395 B1
(45) Date of Patent: Jun. 6, 2006

(54) DIES FOR DIE CASTING ALUMINUM AND OTHER METALS

(75) Inventors: Amitava Guha, Richmond Hts., OH (US); William D. Nielsen, Jr., Avon Lake, OH (US)

(73) Assignee: Brush Wellman, Inc., Cleveland, OH (US)

( * ) Notice: Subject to any disclaimer, the term of this patent is extended or adjusted under 35 U.S.C. 154(b) by 0 days.

(21) Appl. No.: 09/387,894

(22) Filed: Sep. 1, 1999

(51) Int. Cl.
*C22C 19/03* (2006.01)

(52) U.S. Cl. ..... 148/426

(58) Field of Classification Search ..... 420/441; 148/426

See application file for complete search history.

(56) References Cited

FOREIGN PATENT DOCUMENTS

JP 8-260082 * 10/1996

OTHER PUBLICATIONS

Boyer et al., Metals Handbook, Desk Edition, 1985, p. 18.32.

Harkness et al., "Beryllium–Copper and Other Beryllium–Containing Alloys", ASM Metals Handbook, pp. 403–427, vol. 2, Edition 10, 1990.

* cited by examiner

*Primary Examiner*—Roy King
*Assistant Examiner*—Harry D. Wilkins, III
(74) *Attorney, Agent, or Firm*—Calfee, Halter & Griswold, LLP

(57) ABSTRACT

A mold for use in die casting aluminum parts is made from an underaged Ni—Be alloy containing about 1.0 to 2.0 wt. % Be.

22 Claims, 2 Drawing Sheets

DIES FOR DIE CASTING ALUMINUM AND OTHER METALS

FIELD OF INVENTION

The present invention relates to die casting of aluminum alloys and related processes as well as to improved dies useful for these processes.

BACKGROUND

Manufacture of aluminum parts of complex shape by die casting is a well known industrial process. In this process, molten aluminum alloy is injected under high pressure into a metal mold, where it is allowed to solidify and then removed from the mold as a final product.

A major factor in the expense of aluminum die casting is the cost of the dies, including die inserts. Especially where the part to be made has a complex shape, the cost of die preparation can be very high. Therefore, it is important that a die have a reasonable useful life, since replacing the die too often can make the overall die casting process uneconomic.

Many factors contribute to the gradual wearing out of dies used for aluminum die casting over time. Repeated expansion and contraction of the die from thermal cycling leads to formation of cracks in the die surfaces, known as "heat checking." Molten aluminum also tends to alloy with the die surfaces causing attack or "washout" of these surfaces over time. Jets of molten aluminum can also cause some die surfaces to soften and abrade over time. Deposits of molten aluminum also adhere or "solder" to other die surfaces causing the shape of the mold cavity to change.

Most dies used for aluminum die casting are made from H13 tool steel hardened to about 44 to 48 HRC. See page 18*32, *Metals Handbook,* ® 1985 American Society for Metals. This material shows good hardness and resistance to thermal cycle cracking over time. Nonetheless, dies made from this material wear out over time, adding to the expense of the overall die casting process.

Another factor contributing to the overall expense of aluminum die casting relates to the heat conductivity of the mold. Solidification of molten alloy requires that heat be extracted from the mold interior. The faster the heat can be extracted, the faster the molding process can be carried out. In some industrial applications, extraction of heat from the mold is the speed limiting factor of the molding cycle. In these applications, the thermal conductivity of H-13 tool steel constrains faster mold operation, thereby adding to the expense of the overall process.

Accordingly, there is a need for a new material of construction for making dies to be used in aluminum die casting, which material exhibits a superior combination of hardness and thermal conductivity, while also exhibiting the other properties necessary for acceptable mold performance such as resistance against thermal cycle cracking, resistance against washout, resistance against soldering and the like.

SUMMARY OF THE INVENTION

In accordance with the present invention, molds used for aluminum die casting are made from a Ni—Be alloy containing about 1.0 to 2.0 wt. % Be which, preferably, is underaged when the mold is made, and subsequently placed into service.

This alloy has a high thermal conductivity and a low coefficient of thermal expansion and thereby resists thermal cycle cracking in a superior manner. Moreover, this alloy inherently forms a tightly adherent beryllium oxide coating under use conditions which prevents diffusion of aluminum into the Ni—Be die. As a result, washout and soldering are largely prevented.

This alloy also has a thermal conductivity approximately twice that of H13 tool steel, thereby allowing a significant increase in productivity where extraction of heat from the mold is the speed limiting factor.

Finally, because this alloy is purposefully underaged in its preferred embodiment, molds made from this material become harder in use and last longer, since exposure to molten aluminum over time continues the aging process of these materials.

Thus, the present invention provides new molds, as well as mold inserts, which are useful for die casting aluminum and its alloys, and which are also useful for die casting magnesium, copper, and zinc and its alloys, wherein the die is formed from a Ni—Be alloy containing about 1.0 to 2.0 wt. % Be, which alloy is preferably underaged when the mold made.

In addition, the present invention also provides new tools for handling metals in a molten or plastic condition at elevated temperature and abrasive contact, such as molds, mold inserts and hot extrusion dies, the tools being made from a precipitation hardenable alloy which is underaged when the tools is new.

SUMMARY OF THE DRAWINGS

The present invention may be more easily understood by reference to the following drawings wherein.

DETAILED DESCRIPTION

Figure 1:
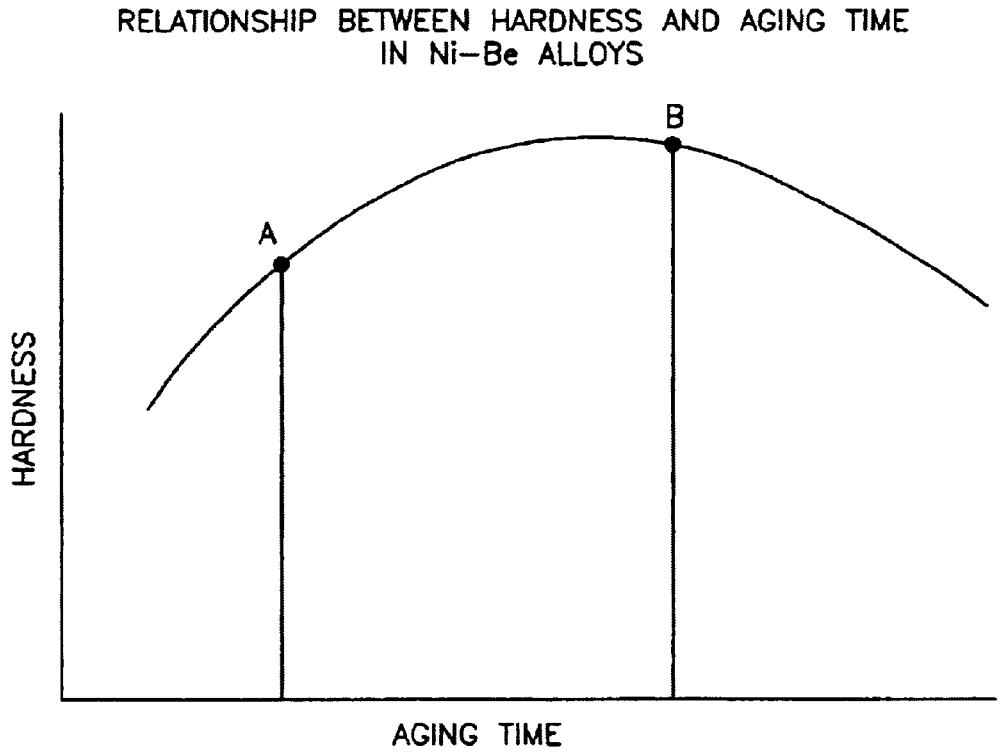
FIG. 1 is a graph illustrating the advantages, in accordance with the present invention, of forming the inventive molds from age-hardenable alloys which are underaged.

In accordance with the present invention, molds and other tools used for handling metals at elevated temperature at high pressure, in a molten or plastic state, are made from a particular Ni—Be alloy.

Molds and Other Tools

The present invention finds widest applicability in the manufacture of molds and mold inserts for use in die casting aluminum and its alloys as well as magnesium, copper, zinc and its alloys. In some applications, the entire mold can be made from Ni—Be alloy in accordance with the present invention. In other applications, such as where the part to be molded has a complex shape, the body of the mold can be made from H-13 tool steel or another material and mold inserts defining the surfaces of fine detail structures such as small fillets, rounds, protrusions, sharp comers, recesses, channels and so forth can be made from Ni—Be alloys in accordance with the present invention. Those skilled in the art understand well how to design molds for particular applications using mold inserts made from different materials so as to achieve an optimal combination of performance at reasonable cost.

In addition to molds and mold inserts, the present invention is also applicable to making other "tools" or "workpieces" which are exposed to similar conditions of repeated abrasive contact with metals in a molten or plastic state at elevated temperature. By "elevated temperature" is meant a temperature significantly above room temperature, e.g. at least about 500° F. For example, the present invention can be used in to manufacture hot extrusion tooling such as hot extrusion dies and other molten metal-contacting equipment used in such processes such as permanent mold casting, semi-solid processing, continuous casting, centrifugal casting, squeeze casting and magneforming of parts made from aluminum, aluminum alloy, magnesium, magnesium alloy, copper, copper alloy, zinc and zinc alloy Thus, it will be appreciated that molds, mold inserts and other tools made in accordance with the present invention need exhibit no particular shape or size to achieve the benefits of the present invention. Rather, so long as they are made from the Be/Ni alloys discussed below, they will attain the enhanced performance and economic advantage made possible by this technology.

Ni—Be Alloys—Chemical Composition

In accordance with the present invention, molds, mold inserts and other tools are made from a Be/Ni alloy containing about 1.0 to 2.0 wt. % Be, with the balance being Ni and incidental impurities.

In accordance with the present invention, it has been found that these alloys exhibit good resistance against soldering and washout by molten aluminum at the elevated temperatures and pressures normally encountered in typical die casting operations. In particular, it has been found that a tightly adherent, continuous native oxide coating of beryllium oxide (BeO), forms on the mold surfaces when exposed to molten aluminum and that this coating serves as a barrier to diffusion of aluminum into the Ni—Be surfaces of the mold material. Because of this barrier, molten aluminum is not allowed to wet the mold surfaces, and consequently aluminum soldering is prevented. In addition, washout is also prevented.

If the amount of beryllium included in the alloy is significantly less than 1.0 wt. %, the BeO coating will be discontinuous and will not prevent soldering and/or washout on all mold surfaces. Accordingly, the amount of beryllium included in the alloy should be enough to effect a continuous oxide coating on the mold surfaces, which is typically about 1.0 wt. % in most applications.

Native nickel metal is not strong enough, by itself, to be used as mold material. However, addition of a small but suitable amount of Be remarkably enhances strength, achieving an alloy strong enough to used in this way.

In this connection, Ni—Be alloys constitute a well-known class of commercially-available alloys known for their excellent physical and electrical properties, especially tensile strength, ductility and electrical conductivity. See Harkness, et al., *Beryllium-Copper and Other Beryllium-Containing Alloys, Metals Handbook*, Vol. 2, 10th Ed., ®1993 ASM Int'l.

The excellent physical properties of these alloys arise through a precipitation-hardening mechanism in which fine nickel beryllide precipitates form in the nickel matrix. So long as beryllium is present in an appropriate amount, a small but suitable portion of this beryllium forms nickel beryllide precipitates of small particle size during precipitation hardening. These small precipitate particles uniformly distribute in the nickel matrix, thereby enhancing its strength. If too much beryllium is present, exceeding the solid solubility limit of beryllium in nickel, the excess beryllium forms primary nickel beryllide particles, 1 μm in diameter or larger, during solidification. These serve no useful purpose in increasing the strength of the alloys, and may have a detrimental effect on the fracture resistance of Ni—Be alloys, since they become preferred sites for nucleation of voids. Therefore, the amount of beryllium in the alloy should not be so much that the alloy becomes too brittle or weak, as a practical matter, from formation of large primary nickel-beryllium intermetallic particles. In alloys containing only nickel and incidental impurities, machining becomes difficult when the beryllium content reaches about 3.0 wt. %. Accordingly, the alloys used to make the inventive molds should preferably contain less than about 3.0 wt. % Be, more preferably less than 2.5 wt. %. Most desirably, the amount of Be in the alloy should not exceed about 2.0 wt. % in an alloy containing only Ni and incidental impurities.

In preferred embodiments of the present invention, the Ni—Be alloys may contain one or more of the following additional ingredients in the following amounts:

TABLE 1

Concentrations of Optional Ingredients (wt. %)

| Component | Desired | Preferred |
|---|---|---|
| Ti | ≦5.0 | 0.25 to 1.0 |
| Cu | ≦30 | ≦15.0 |
| Mo | ≦3.0 | ≦2.0 |
| Al | ≦4.0 | 0.2 to 0.6 |
| Co | ≦1.0 | ≦0.4 |
| C | ≦0.1 | ≦.05 |
| Mg | ≦0.5 | ≦0.4 |
| Cr | ≦14 | ≦12 |
| Fe | ≦5.0 | ≦0.5 |
| Y + RE's | ≦3.0 | ≦1.0 |

The reasons why the foregoing concentration ranges are desirable is set forth below:

Ti has been shown to enhance the resistance of Ni—Be alloys to softening at elevated temperatures. Accordingly, the amount of Ti added, if present, should be enough to show this effect. If too much Ti is present, however, it will react with the Be in the system to form beryllide particles when the alloy is heated to elevated temperature. This depletes beryllium from the nickel matrix and therefore negatively impacts the strength of the alloy.

Cu enhances thermal conductivity and reduces cost without adversely affecting the other properties of Ni—Be alloys in any significant way. In addition, Cu lowers the melting point, improves the high temperature strength and improves the machinability and corrosion resistance of these alloys. However, too much copper causes a deterioration in both strength and hardness of these alloys.

Mo improves the hardness and strength of Ni—Be alloys. Too much Mo, however, causes the alloys to become brittle through formation of intermetallic molybdenum beryllide particles.

Al strengthens Ni—Be alloys through precipitation of nickel aluminide particles. Too much Al, however, lowers thermal conductivity as a result of the Al going into solid solution in the Ni alloy matrix.

Co acts the same way as Mo. It improves hardness and strength but too much causes the alloy to become brittle through the formation of beryllides.

C, when in spheroidal form, improves machinability. Too much C, however, makes machinability difficult though formation of carbides of titanium, beryllium and molybdenum. Corrosion resistance suffers too.

Mg promotes spheroidization of C.

Cr improves the oxidation resistance of the alloys. Cr promotes formation of an oxide protective coating and thereby allows the amount of beryllium to be reduced somewhat. However, Cr does not enhance the strength of Ni in the same way as Be, and so Cr cannot totally replace Be. Also, Cr forms beryllides, which should preferably be avoided.

Fe is beneficial for improving the strength. However, Fe in solid solution in excessive amounts may degrade the thermal conductivity of the alloy.

Y and the Rare Earth elements, individually and collectively, improve oxidation resistance of the alloy by enhancing spalling resistance of the oxide coating. Too much Y or Rare Earth, however, leads to excessive brittleness by forming their own beryllides.

From the foregoing, it can be seen that the above optional elements provide additional benefits, if added in appropriate amounts, but can cause negative effects if over-added. It can also be seen that these optional elements may react with one another and especially with the beryllium in the system rendering these elements unavailable for their intended purpose. In a similar way, some optional elements may serve the same purpose as other elements in the system, thereby reducing the amounts these elements should be added below the levels specified above. Those skilled in the art will therefore appreciate that the specific amount of each element to be added in a particular application of the present invention will depend, among other things, on the other elements in the system. In any event, care should be taken to minimize or avoid depletion of Be from the Ni matrix as well as production of excessive beryllides in the system, so that a desirable combination of strength, toughness and hardness can be achieved and further so that the BeO coating inherently produced remains continuous.

Alloys which can be used in accordance with the present invention, at least in terms of chemistry, are already known. One such alloy is disclosed in commonly-assigned application Ser. No. 08/906,236, filed Aug. 8, 1997, now U.S. Pat. No. 5,911,948, entitled Machinable Lean Beryllium-Nickel Alloys Containing Copper for Golf Clubs and the Like, the disclosure of which is incorporated herein by reference.

Ni—Be Alloys—Precipitation Hardening

Forming useful products from Ni—Be alloys derived from an ingot ("as cast Ni—Be alloys) typically involves a series of heating and working steps to impart the desired shape, grain structure and properties to the alloy. These steps in the aggregate can be considered as constituting (a) a shaping regimen for changing the bulk shape of the alloy as derived from the ingot into a shape approaching the final desired shape of the product (a "near net shape") and also for imparting a finer, more nearly uniform grain structure to the alloy, and (b) a precipitation hardening regimen for nucleating and growing the fine nickel beryllide precipitates responsible for hardening.

Commercially, the shaping regimen involves one or more working steps and solution heat treatment (annealing) steps. Annealing is typically done by heating the alloy at about 1500–1900° F. (815–1040° C.) for 1 h at temperature for each inch or fraction of an inch of section thickness. The purpose is to put beryllium and other alloying additions into solid solution, followed by rapid quenching to retain these ingredients in solid solution. The optimum annealing time is typically determined from aging response studies, mechanical testing and microscopic examination of the alloy. Annealing dissolves a maximum amount of beryllium and other components that might be present, simultaneously producing a grain structure which is more nearly uniform. Internal stresses in the alloy are also reduced by annealing. Working can be done either at elevated temperatures ("hot working") or at lower temperatures such as room temperature ("cold working"). Both working and annealing may be done multiple times, especially if change in shape is large, with a final solution anneal usually being done last Precipitation hardening ("age hardening") of Ni—Be alloys is typically done by heating the alloy at about 600–1300 F. (315–705 C.) for a time sufficient to develop maximum hardness in the alloy, typically between about 1 to 10 hours. In general, each Ni—Be alloy has its own particular time/temperature combination leading to maximum hardness, meaning that if the alloy is heated either too little or too much its hardness and other properties are less than optimal. Thus, it is conventional to refer to such alloys as being "peak aged" if age hardened at or near optimal time/temperature conditions, or as underaged or overaged if heated too little or too much.

This is illustrated in FIG. 1, which is a graph illustrating the relationship between the hardness of a typical Ni—Be alloy and aging time at a constant age hardening temperature. As shown in this figure, when the alloy is heated to age hardening temperature after final solution annealing, the hardness the alloy increases from an initial value to a peak or maximum value over time. Then, as the alloy continues to be heated, the hardness of the alloy decreases from its maximum down to a significantly lower level. The alloys is said to be peak aged if age hardened at or near optimal time/temperature conditions, or as underaged or overaged if heated too little or too much, as illustrated in the figure.

In accordance with the present invention in its preferred embodiment, the Ni—Be alloys discussed above are underaged when the mold is made. That is to say, the Ni—Be alloy forming the mold, mold insert or other tool made in accordance with the present invention is in an underaged condition when the mold manufacturing process is complete and the mold is delivered to the end user ready for use, i.e. when the mold is "new." By underaged is meant that the hardness of the alloys is 95% or less, preferably 90% or less, more preferably 80% or less, and even 75% or less, of its peak age hardness when measured by the Rockwell Hardness C scale.

In accordance with the present invention, it has been found that molds made in this manner will actually become harder and tougher as a result of continued commercial use rather than softer and weaker, as in the case of conventional molds. In particular, it has been found that molds made in this manner continue precipitation hardening under the conditions encountered in die casting on an industrial scale and that this phenomenon can be taken advantage of by providing molds ready for commercial use in an underaged rather than a peak aged condition. Accordingly, when molds of the present invention are used industrially, they become harder and tougher rather than softer and weaker. In addition, the useful lives of these molds may be longer because their alloys are in the early stages in terms of age hardening response when they start their useful lives. This can be readily appreciated by reference to FIG. 1 where it can be seen that a mold made from an alloy which begins service under aging conditions A will exhibit an increase in hardness and a longer overall useful life than a mold made from an alloy which begins service under aging conditions B.

Ni—Be alloys exhibit the property that cold working before age hardening increases both the rate and magnitude of the precipitation-hardening response, at least up to a certain maximum hardness level inherent for each alloy. Therefore, in manufacturing the inventive molds, the Be/Ni workpiece produced after final solution annealing may be desirably cold worked, preferably in an amount of about 20–90% in terms of area reduction, before precipitation hardening. Also, since it is easier to machine the alloy while it is softer rather than harder, final shaping of the workpiece, especially machining, is desirably carried out before precipitation hardening.

The particular conditions to be used for precipitation hardening specific alloys in accordance with the present invention can be easily determined by routine experimentation. Generally, precipitation hardening can be carried out at temperatures from 700° F. to 1050 F. (370° C. to 565° C.), preferably 775° F. to 875° F. (410° C. to 470° C.), for 4 to 10 hour,preferably 6 to 8 hours, with higher temperatures being associated with shorter processing times and vice versa. If desired, precipitation hardening can be done in steps, for example by treating the work piece at 600° F. to 700° F. (315° C. to 370° C.) for 1 to 3 hours followed by a second precipitation hardening heat treatment at 775° F. to 875° F. (410° C. to 470° C.) for 1 to 3 hours. Regardless of how precipitation hardening is done, it is desirable that the alloy forming the final mold product be in an underaged condition, as discussed above.

Ni—Be Alloys—Properties

The alloys described above have a unique combination of properties making them ideally suited for making molds for die casting aluminum and other tools encountering similar use conditions.

For example, the hardness and toughness of these alloys, if underaged, increases rather than decreases over time when used industrially for aluminum die casting and other analogous processes. In addition, these alloys have thermal conductivities about double the thermal conductivity of conventional H13 tool steel. For example, the thermal conductivities of the alloys used in the present invention are typically at least about 20, preferably at least about 25, Btu/ft.hr.° F. Moreover, their resistance to thermal cycle cracking is also vastly superior to that of H13 tool steel. Furthermore the alloys are immune to liquid metal attack in the form of soldering or alloying, thereby preventing "washout" or erosion of the die.

Figure 2:
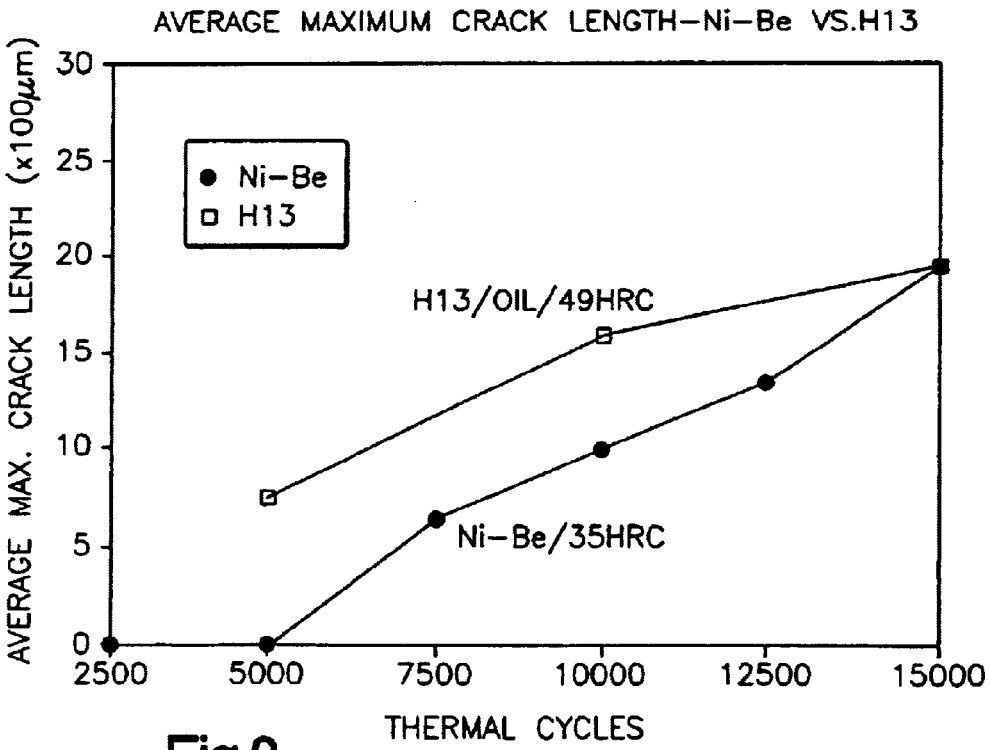
FIGS. 2 and 3 are graphs illustrating the superior resistance against thermal cycle cracking exhibited in a thermal fatigue test by the alloys used to form the inventive molds relative to premium grade H13 tool steel.
Figure 3:
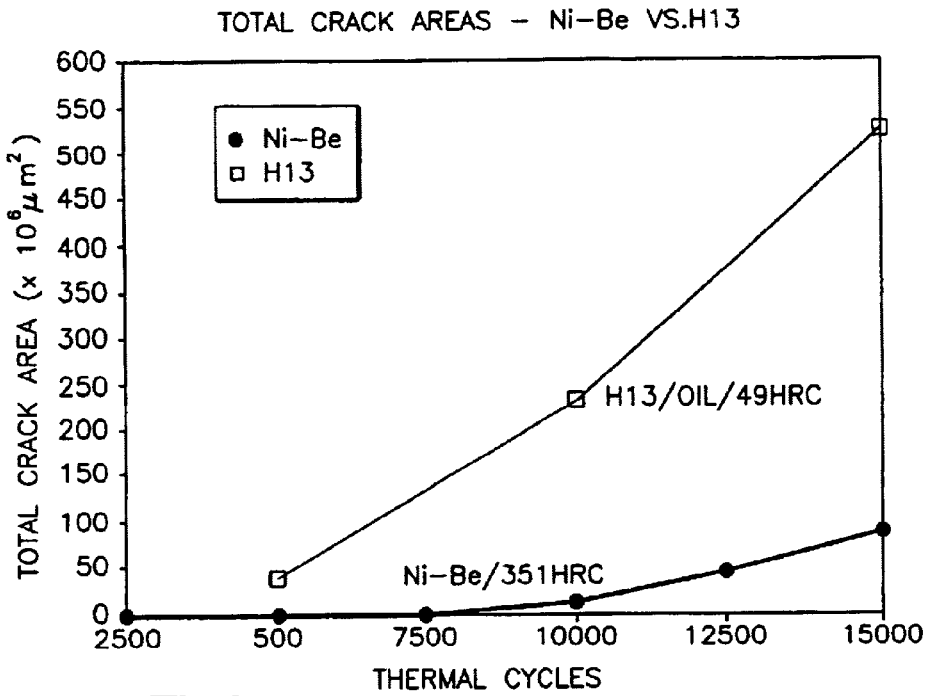

In this connection, FIGS. 2 and 3 illustrate the results of certain thermal cycling tests conducted on a two different samples of metals used useful in making aluminum die casting molds, one sample being formed from H13 tool steel having a hardness of HRC 49, the other being formed from a Ni—Be alloy containing 2.00 wt. % Be and 0.5 wt. % Ti, in accordance with the present invention. The Ni—Be sample was prepared in an underaged condition, as reflected by the fact that its hardness was only HRC 35, some 70% of its peak aged hardness of HRC 48. In these tests, samples measuring 1×1×7 inches were repeatedly dipped into and then withdrawn from a molten bath of aluminum alloy 380 maintained at a temperature of 1350° F. (730 C.). A sample of each alloy was withdrawn from the test and analyzed at 100× by an optical microscope for average maximum crack length and total crack area after 5000, 7500, 10,000, 12,500 and 15,000 thermal cycles. The average maximum crack length is defined as the average length of the longest crack measured on each of the four comers of the test specimen, whereas the total crack pattern area represents the summation of the squares of the crack length or crack area for the four comers of the test specimen.

As shown in FIGS. 2 and 3, the average maximum length of the cracks formed in the Ni—Be alloy of the present invention was less than that of the H13 alloy over the entire test until its termination at 15,000 cycles. Moreover, the total area of these cracks in the Ni—Be alloy was less than that of the H13 alloy over the entire test, with the difference between the total crack areas of the Ni—Be and H13 alloys growing remarkably larger as the test terminated. This shows clearly that the Ni—Be alloys used to make the inventive molds have a resistance to thermal cracking significantly greater than the H13 tool steel used to make conventional aluminum die casting molds.

In addition to superior resistance to thermal cycle cracking and superior thermal conductivities, the alloys used to form the inventive molds also have other advantageous properties as set forth below:

TABLE 2

Selected Properties of Underaged Ni—Be Alloys and Comparison with H13 Tool Steel

| Property | Ni—Be | H13 |
|---|---|---|
| Thermal Conductivity (Btu/ft.hr.F) | 28 | 15 |
| Coefficient of Thermal Expansion (in./in./F) | $8.0 \times 10^{-6}$ | $7.0 \times 10^{-6}$ |
| Hardness (Rockwell C) | 36 | 49 |
| Elongation (Percent) | 20 | 12 |
| Room Temperature Yield Strength (ksi) | 125 | 185 |
| 1000° F. Yield Strength (ksi) | 100 | 130 |
| Thermal Cycling Cracking Resistance[a] after 15000 cycles (Total Crack Area × $10^6$ $\mu m^2$) | 75 | 525 |

[a]The smaller the crack area, the greater is the resistance to cracking resulting from thermal cycling As is apparent from this table, the Ni—Be alloys of the present invention have an extraordinary combination of properties making them ideally suited for use in making molds for aluminum die casting and other similar applications.

The present invention, therefore, contemplates new tools formed from Ni—Be alloys having a combination of properties not available in the past. In addition, the present invention further contemplates a new process for manufacturing such alloys in which precipitation-hardening after final solution annealing is done under different conditions than carried out in the past.

Although the present invention has been described above in connection with molds useful for die casting of aluminum, it should be appreciated that many modifications can be made without departing from the spirit and scope of the present invention. All such modifications are intended to be included within the scope of the present invention, which is to be limited only by the following claims.

We claim:

1. A tool for contacting a molten metal at elevated temperature, wherein the tool is made from an underaged Ni—Be alloy containing about 1.0 to less than 3.0 wt. % Be.

2. The tool of claim 1, wherein the tool is a mold or mold insert.

3. The tool of claim 2, wherein the Ni—Be alloy has a thermal conductivity of at least about 20 Btu/ft.hr.F.

4. The tool of claim 2, wherein the Ni—Be alloy has a thermal conductivity of at least about 25 Btu/ft.hr.° F.

5. The tool of claim 4, wherein the hardness of the Ni—Be alloy is 90% or less of its peak aged hardness.

6. The tool of claim 5, wherein the hardness of the Ni—Be alloy is 75% or less of its peak aged hardness.

7. The tool of claim 4, wherein the Ni—Be alloy contains at least one additive selected from the group consisting of Al, C, Co, Cr, Cu, Fe, Mg, Mo, Ti, Y and the Rare Earth Elements.

8. The tool of claim 4, wherein the alloy contains about 1.0 to 2.0 wt. % Be.

9. A tool for contacting a molten metal at elevated temperature, wherein the tool is made from an underaged Ni—Be alloy, the amount of Be in the Ni—Be alloy being sufficient Be so that a continuous coating of beryllium oxide forms on the surfaces of the tool but not so great that the alloy becomes brittle.

10. A tool for contacting a molten metal at elevated temperature, wherein the tool is made from an underaged Ni—Be alloy containing about 1.0 to less than 3.0 wt. % Be, at least one surface of the tool having a tightly adherent beryllium oxide coating sufficient to substantially prevent aluminum soldering when the surface is contacted with molten aluminum.

11. The tool of claim 10, wherein the hardness of the Ni—Be alloy is 90% or less of its peak aged hardness.

12. The tool of claim 11, wherein the hardness of the Ni—Be alloy is 75% or less of its peak aged hardness.

13. The tool of claim 10, wherein the Ni—Be alloy contains at least one additive selected from the group consisting of Al, C, Co, Cr, Cu, Fe, Mg, Mo, Ti, Y and the Rare Earth Elements.

14. The tool of claim 10, wherein the alloy contains about 1.0 to 2.0 wt. % Be.

15. A process for solidification of a molten metal selected from aluminum, aluminum alloy, magnesium, magnesium alloy, copper, copper alloy, zinc and zinc alloy comprising charging the molten metal into a die, the die optionally having a die insert, and allowing the molten metal to solidify therein, wherein the die or die insert or both are made from an underaged Ni—Be alloy containing about 1.0 to less than 3.0 wt. % Be.

16. The process of claim 15, wherein the Ni—Be alloy contains about 1.0 to 2.0 wt. % Be.

17. The process of claim 15, wherein the hardness of the Ni—Be alloy is 90% or less of its peak aged hardness.

18. The process of claim 17, wherein the hardness of the Ni—Be alloy is 75% or less of its peak aged hardness.

19. The process of claim 15, wherein the Ni—Be alloy contains at least one additive selected from the group consisting of Al, C, Co, Cr, Cu, Fe, Mg, Mo, Ti, Y and the Rare Earth Elements.

20. A mold or mold insert for contacting a molten metal at elevated temperature, wherein the mold or mold insert is made from an underaged Ni—Be alloy, the amount of Be in the Ni—Be alloy being sufficient Be so that a continuous coating of beryllium oxide will form on the surfaces of the tool when contacted with molten aluminum but not so great that the alloy becomes brittle.

21. The mold or mold insert of claim 20, wherein the alloy contains about 1.0 to less than 3.0 wt. % Be.

22. The mold or mold insert of claim 21, wherein the alloy contains about 1.0 to less than 2.0 wt. % Be.

* * * * *